US007648747B2

(12) United States Patent
Straka et al.

(10) Patent No.: US 7,648,747 B2
(45) Date of Patent: Jan. 19, 2010

(54) LAWN ACCESSORY

(76) Inventors: Stephen P. Straka, 19101 Zerulon St. N.W., Elk River, MN (US) 55330; Mark D. Patraw, 115 E. Geranium St., St. Paul, MN (US) 55117

( * ) Notice: Subject to any disclaimer, the term of this patent is extended or adjusted under 35 U.S.C. 154(b) by 491 days.

(21) Appl. No.: 11/109,546

(22) Filed: Apr. 19, 2005

(65) Prior Publication Data

US 2006/0233981 A1 Oct. 19, 2006

(51) Int. Cl.

| | |
|---|---|
| ***A47G 19/22*** | (2006.01) |
| ***B65D 85/84*** | (2006.01) |
| ***B28B 3/00*** | (2006.01) |
| ***A41G 1/00*** | (2006.01) |

(52) U.S. Cl. ..... 428/34.4; 206/524.3; 264/333; 156/61; 220/908

(58) Field of Classification Search ..... 428/34.4; 206/524.3; 156/61; 264/333; 220/908
See application file for complete search history.

(56) References Cited

U.S. PATENT DOCUMENTS

| | | | | |
|---|---|---|---|---|
| D138,327 | S | 7/1944 | Smith et al. | |
| 3,109,193 | A * | 11/1963 | Erickson | 15/235.3 |
| 3,773,286 | A * | 11/1973 | Govoni et al. | 248/97 |
| 4,294,374 | A * | 10/1981 | Ames | 220/649 |
| 4,450,974 | A | 5/1984 | Winden | |
| 4,572,400 | A | 2/1986 | Sosa | |
| 4,642,960 | A * | 2/1987 | Wallover, III | 52/390 |
| 4,827,645 | A * | 5/1989 | Stamps, Jr. | 40/567 |
| 5,183,175 | A * | 2/1993 | Brown | 220/23.87 |
| 5,502,941 | A | 4/1996 | Zember et al. | |
| 5,543,100 | A | 8/1996 | Kluh et al. | |
| 5,673,512 | A * | 10/1997 | Dupre | 47/81 |
| 5,816,005 | A * | 10/1998 | Han | 52/391 |
| 6,250,492 | B1 * | 6/2001 | Verbeek | 220/495.11 |
| D445,982 | S * | 7/2001 | Skalka | D34/5 |
| 6,623,813 | B2 | 9/2003 | Hsu | |
| 2002/0086122 | A1 * | 7/2002 | Sakai | 428/15 |
| 2002/0088457 | A1 * | 7/2002 | McDonald | 126/512 |
| 2002/0148836 | A1 * | 10/2002 | Santa Cruz et al. | 220/500 |

* cited by examiner

*Primary Examiner*—Rena L Dye
*Assistant Examiner*—James Yager
(74) *Attorney, Agent, or Firm*—Kinney & Lange, P.A.

(57) ABSTRACT

The present invention is a lawn accessory comprising a structural shell. The shell is constructed to have a wall containing both inner and outer surfaces, and a bottom member which together form an inner volume. An adhesive layer surrounds the outer wall surface of the shell and is comprised of a mortar. A decorative layer comprised of a plurality of synthetic stones is attached to the adhesive layer and spaces between the stones are filled with mortar to complete the lawn accessory.

15 Claims, 3 Drawing Sheets

LAWN ACCESSORY

BACKGROUND OF THE INVENTION

The invention relates to decorative and functional lawn accessories (such as trash receptacles) constructed with imitation stone surfaces, and a method and technique for creating such imitation stone surfaces on the lawn accessories.

Solid stone work has long been used in architecture for its aesthetic values, including interesting visual affects. However, natural stone work employed in constructing structures is difficult and expensive to use. Such structures require the expertise of skilled stone masons who shape, cut, and apply the natural stone to surfaces. This is a time consuming and expensive undertaking. Due to this expense, stone work is limited in use to large structural areas. Another disadvantage of using natural stone aside from expense, is the weight associated with final structures.

A possible solution to the above-stated drawbacks is to use stone veneers to give structures a stone like appearance. Masons may apply a relatively thin veneer of stone to existing structures. However, veneer is still heavy, and difficult to apply. Due to the thin nature of the veneer, the stone breaks rather easily during application. Further, the veneer must be manufactured in slabs from a full natural stone. This again adds expense and complications to the manufacturing process.

Another possible solution for creating small structures with stone-like appearance is to create the small structure from prefabricated fiberglass or thermoplastics. Fiberglass is a dangerous and difficult material to work with, and often times requires safety precautions in manufacturing. The base materials used are environmentally unfriendly. Also, both fiberglass and polymer products face problems in matching the look of natural materials. Paint used to simulate stone appearances does not adhere well to either product and often chips and cracks after exposure to the elements of nature. The materials are also lightweight and lawn accessories constructed from these materials must be secured, or a strong wind will blow them over. Also, the products are susceptible to damage from ordinary usage. The present invention seeks to address these drawbacks in the field of lawn accessories.

BRIEF SUMMARY OF THE INVENTION

The present invention is a lawn accessory covered with synthetic stones. The lawn accessory of the current invention achieves the properties associated with a natural stone-like finish, but weighs less and costs less than the same product made with natural stone. Specifically, the lawn accessory includes a structural shell constructed to have a wall containing both inner and outer surfaces, and a bottom member which together form an inner volume. An adhesive layer surrounds the outer wall surface of the shell and is comprised of a mortar. A decorative layer comprised of a plurality of synthetic stones is attached to the adhesive layer to complete the lawn accessory.

Further, a method for constructing such a lawn accessory is disclosed. First, an structural shell is obtained. Next, a reinforcement layer is attached to the shell. An adhesive coat of mortar is applied to the reinforcement layer about the wall of the shell. Upon curing of the coat of mortar, additional mortar is applied to the first coat and to a plurality of synthetic stones. The synthetic stones are set about the shell to create a decorative layer. Mortar is grouted between stones to tightly secure the stones. Finally, a wire brush is used on the grouted joints to create a smooth, finished look.

DETAILED DESCRIPTION

Figure 1:
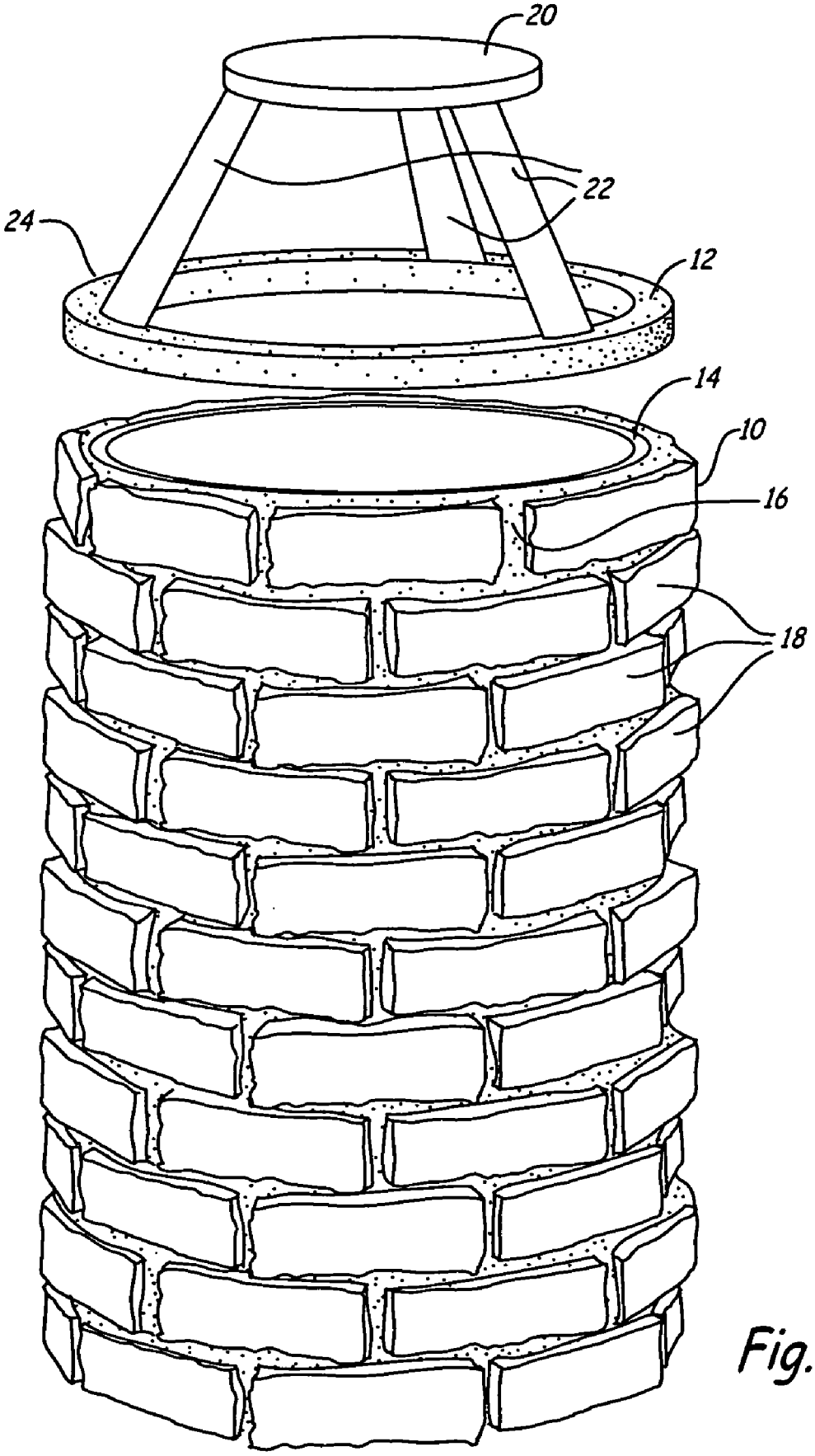
FIG. 1 is a perspective view of a trash receptacle covered with synthetic stone and a corresponding lid.

FIG. 1 illustrates a lawn accessory 10 covered with synthetic stones of the present invention. A corresponding lid 12 is also illustrated. For ease in understanding the following invention, like components are designated with the same reference numerals throughout the various figures.

In the embodiment shown, the lawn accessory 10 is a cylindrical trash receptacle. The trash receptacle is comprised of an inner container 14, an adhesive layer 16, and a plurality of synthetic stones 18. Inner container 14 is illustrated as a cylindrical barrel comprising a wall containing an inner wall surface and an outer wall surface, a bottom member connected to the wall, and an open top. In alternate embodiments, the inner container is comprised of other geometries such as rectangular or trapezoidal prisms and cubes containing an inner wall surface, outer wall surface, and an opening on at least one surface. Inner container 14 is preferably constructed from a thermoplastic or similar polymer. Although other materials may be used in construction of inner container 14 including metal and wood, polymer is preferred due to its flexibility, weight, and availability. A polymer inner container 14 is weather resistant and will not rust or rot, and is impervious to many chemicals found in refuse discarded into inner container 14. Further, an inner container 14 made from polymer has a smooth surface that prevents most contents from adhering to the wall surfaces of the inner container 14, thus allowing for easy removal of contents placed in the container. This results in easy cleaning of the inner container 14.

Adhesive layer 16 surrounds inner container 14. Preferably, adhesive layer 16 is comprised of a mortar, such as cement or grout. Adhesive layer 16 is an acrylic liquid solution used as an adhesive in an alternate embodiment. The adhesive layer 16 attaches the synthetic stones 18 to inner container 14. The adhesive layer 16 is applied in a single coat, or in multiple coats. The adhesive layer 16 encompasses the outer surface of the wall of inner container 14.

Synthetic stones 18 are prefabricated structures of imitation or artificial stones. Preferably, the synthetic stones 18 are a man made veneer stone constructed from a mix of gravel, sand, portland cement, water, and coloring. Alternatively, synthetic stones 18 are constructed from epoxies, resins, cement, stucco, and other similar materials, or a combination thereof which will be later described. Properly constructed and molded, synthetic stones 18 have excellent texture and properties such as a good surface hardness, a good surface abrasion resistance and the like. Also, the synthetic stones 18 are light-weight and have a high hardness and a high strength, and can easily be adjusted to a desired shapes, sizes, and thicknesses with easy fabrication techniques at a low cost.

The lid 12 is comprised of a top plate 20, supports 22 and a ring 24. Preferably, ring 24 is constructed from same materials used to construct synthetic stones 18 or adhesive layer 16. Ring 24 is sized to have an inner diameter nominally the same as or smaller than the inner diameter of inner container 14. Ring 24 is also sized to have an outer diameter greater than the inner diameter of inner container 14. This allows ring 24 to rest atop lawn accessory 10 without falling into inner container 14. The thickness of ring 24 is determined by the material used. The ring 24 must be structurally sound and free standing, and thus won't break or crack from normal handling associated with its intended purpose of a removable protective covering of inner container 14. Preferably, the width of ring 24 is nominally the thickness corresponding to the thickness of synthetic stones 18. In this arrangement, lid 12 can rest on lawn accessory 10 without the outer edge of the ring 24 overshadowing the top of lawn accessory 10.

In the embodiment shown, top plate 20 is a flat cylindrical disk. Top plate 20 has a diameter smaller than that of ring 24. Top plate 20 is constructed of the same materials as ring 24, or made of another rigid material.

Ring 24 is connected to top plate 20 by supports 22. Supports 22 are attached to both ring 24 and top plate 20. Supports 22 attach with the use of common fasteners such as nuts and bolts or clips. In an alternate embodiment, supports 22 are attached through the use of adhesives such as epoxies or cements, or are prefabricated as a single structure with top plate 20. In the embodiment shown, there are three angled supports 22 between ring 24 and top plate 20. Top plate 20 and ring 24 are concentrically aligned. The supports 22 are equal distances from one another around the circumference of both ring 24 and top plate 20. The length of the supports 22 is determined by the dimensions of the objects to be placed in lawn accessory 10. When lawn accessory 10 is a trash receptacle, supports 22 are sized to allow the insertion of waste into the inner container 14, preferably spacing the top plate 20 a height of 12 inches from the ring 24.

The lid 12 is removable and serves several purposes. The top plate 20 acts as a wind break and protects the contents from the elements associated with weather. When lid 12 is removed, greater access is given to the inner container. Plastic liners, such as ordinary trash bags, can be inserted to protect the inner container 14. The plastic liners also allow for easy removal of contents placed in the inner container 14. The lid 12 is used to secure the plastic liner from slipping to the bottom of lawn accessory 10. Once the plastic liner is full, lid 12 is removed to provide access to extract the plastic liner and its contents from inner container 14. Synthetic stones 18 applied to the ring 24, supports 22, and top plate 20 further add to the aesthetics and weight of lid 12. At a proper weight, lid 12 rests on lawn accessory 10 without attaching or fastening, and will not be dislodged from its placed position from ordinary wind or slight exertions of force, such as bumping or kicking the lawn accessory 10. Lid 12 is readily removed with an exerted force from a person wishing greater access to the inner container 14.

FIG. 1 illustrates all synthetic stones 18 as being approximately uniform in size. This allows for a repeatable pattern of synthetic stones 18 in covering inner container 14 with adhesive layer 16 and synthetic stones 18. The repeatable pattern allows for creating a mass produced, uniform product. Further, only a single mold is required to cast synthetic stones 18 translating in easier and cheaper manufacturing of lawn accessory 10.

Figure 2:
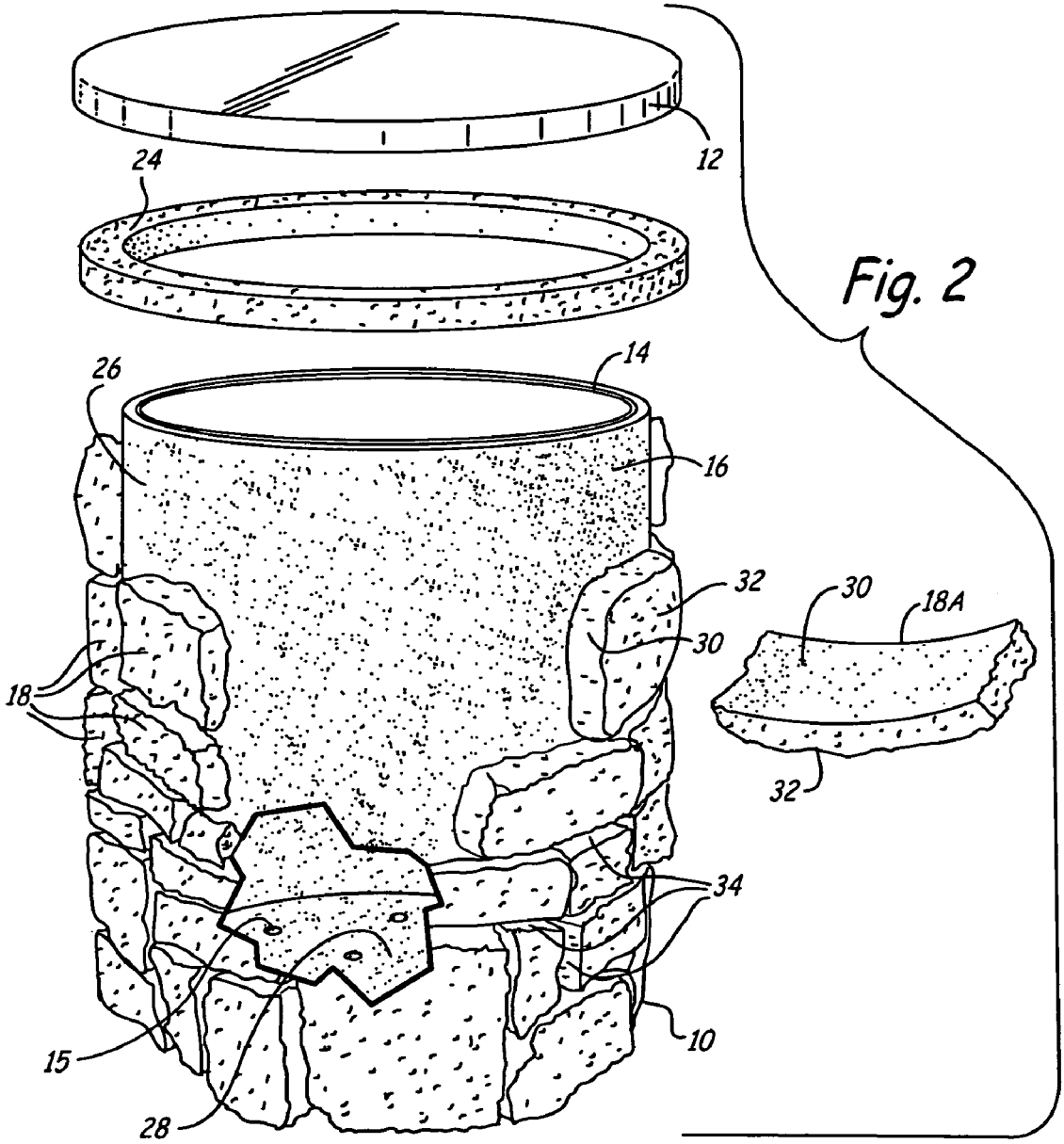
FIG. 2 is a perspective view of a partially constructed trash receptacle made with synthetic stone.

FIG. 2 is a perspective view of a partially constructed lawn accessory 10. As illustrated, lawn accessory 10 is a trash receptacle and contains lid 12, inner container 14, adhesive layer 16, and synthetic stones 18. Inner container 14 is pictured as a cylindrical barrel which is available as stock at discount stores and hardware stores. Inner container 14 is comprised of upright cylindrical wall 26 and bottom member 28. Inner container 14 is open at the top. The inner surface of wall 26 and top face of bottom member 28 define an internal volume that can be used for temporary storage of waste items. Common sizes available include 35 and 50 gallon barrels. In an alternative embodiment, inner container 14 is specially fabricated to obtain a desired inner volume. Preferably, the inner container 14 contains prefabricated holes 15 or is perforated on the bottom surface to allow fluids to drain out of the container. The holes 15 are sized to allow fluid to drain while keeping solids in the container.

In the embodiment shown in FIG. 2, lid 12 is constructed by making a ring 24. Preferably ring 24 is constructed from the same materials used to construct synthetic stones 18 or adhesive layer 16. In this embodiment, ring 24 is sized to have an inner diameter equal to the outer diameter of inner container 14 with adhesive layer 16 applied. The thickness of ring 24 varies. The thickness is determined by the desired outer diameter for the ring 24. The desired outer diameter is determined by stock sizes of covers for trash receptacles that comprise lid 12. In the embodiment shown, the ring 24 is of a thickness that overshadows synthetic stones 18 to provide a proper fit for lid 12. In this embodiment, a preexisting stock lid's inner diameter is measured to become the nominal outer diameter of ring 24.

The width of ring 24 also varies, and is determined by the material used. The ring 24 is structurally sound, and won't break or crack from the usual use of covering and uncovering the trash receptacle with the stock lid 12. Another factor in the the width of ring 24 is the placement of stones on inner container 14. Ring 24 sits down about inner container 14 with adhesive layer 16 so that the top surface of ring 24 is flush with the top surface of inner container 14. Adhesive layer 16 is used to permanently attach ring 24 about inner container 14. The width of ring 24 extends down to a point where the synthetic stones 18 cease to cover inner container 14, leaving a small gap between the ring 24 and synthetic stones 18 approximately equal to the size of gaps 34 between synthetic stones 18.

Adhesive layer 16 covers the entire outer surface of wall 26. Preferably, adhesive layer 16 is a mortar. Adhesive layer 16 is used to secure synthetic stones 18 and ring 24 about inner container 14. As illustrated, synthetic stones 18 contain varying sizes and shapes. This allows for a random pattern to be used to create a unique aesthetic appearance on the inner container 14. However, a variety of molds or an adjustable mold system is required to cast synthetic stones 18.

Also illustrated in FIG. 2 is synthetic stone 18A which has not yet been secured to inner container 14 via adhesive layer 16. Preferably, synthetic stone 18A is a prefabricated artificial, man-made structure constructed to look like natural stone such as granite, marble, flagstone, slate and the like. In alternate embodiments, synthetic stone 18A is a man-made product constructed to simulate a masonry product.

The fabrication of the synthetic stones 18 starts with a mold. The mold can be constructed from a number of materials including silicon rubber, fiberglass, thermoplastics, or the like. The mold is a negative reproduction of a natural stone, or independently created using mold making techniques common in the industry.

After constructing or obtaining the mold, the synthetic stone 18 is cast. This process is done by inserting a mix of synthetic resin and particulate matter, such as powder or sand, into the mold. The particulate matter is usually obtained from natural stone. Typically, natural stone is pulverized and separated by meshes to get particulate matter classified according to size. The natural stone particulate matter is mixed with calcium carbonate or similar inorganic material and a resin, and then cured to form an artificial stone. A starting natural stone powder or sand, a resin and the like are mixed, and the mixture is poured into a mold. The mold is allowed to cure at normal pressure. The synthetic stone 18 is then removed from the mold. If the synthetic stone 18 is unacceptable as cast, the stone is cut to an acceptable shape or size. This results in a stone that is much lighter than natural stone formed under extreme conditions of pressure and temperature. An alternative method of casting stone involves applying pressure to the stone powder and resin mix to achieve differing properties.

When manufacturing a synthetic stone 18 using a powder or sand of a natural stone and a synthetic resin, it is required that the starting materials are used at a predetermined mixing ratio. The mixing ratios are compositions known by those that practice in the art, with differing ratios resulting in differing natural stone appearances. The composition of the synthetic stone 18 greatly influences the ease at which a stone is molded. Those in the art recognize that as an amount of a resin component is increased to improve a fluidity of the molding mixture to make the casting process easier, aesthetic and other properties are compromised.

The mix of resin and particulate matter is a thick slurry. After casting the slurry into the mold, the mold is then allowed to cure so that the slurry becomes solidified. After solidification, the synthetic product is removed from the mold resulting in the finished cast synthetic stone 18. This process is also used to create synthetic brick, clay tile, or other similar synthetic masonry finishes.

Synthetic stone 18A contains an inner surface 30 and an outer surface 32. In one embodiment, inner surface 30 is of a curvilinear construction. Preferably, the curvilinear inner surface 30 of synthetic stone 18A has a relatively rough surface. The rough surface allows for improved bonding to the adhesive layer 16. The radius of the curvilinear arc of inner surface 30 corresponds to the radius from the center of inner container 14 to the outer surface of the adhesive layer 16. Outer surface 32 of stone 18A may also be a curvilinear surface. Preferably, the surface is rougher than that of the inner surface and simulates the properties associated with the aesthetics of natural stone. The molding of synthetic stones 18 with curvilinear inner and outer surfaces 30 and 32 allows stones to better fit around inner container 14, and adds to the ease of application with adhesive layer 16. Also, the curvilinear faces of stone 18A eliminate volume of the stone compared to a stone of regular flat cut to cover the same area. This shape also reduces the weight of the lawn accessory 10 as there is less material in both the stone and amount of mortar required to apply the stone to inner container 14.

To attach stone 18A to the lawn accessory 10, the mortar used for adhesive layer 16 is applied to inner surface 30. Next, the synthetic stone 18 is placed against the uncured mortar of adhesive layer 16. The synthetic stone 18A is held in place and allowed to set. This process is repeated to set other synthetic stones 18.

Synthetic stones 18 are placed near each other, but a gap 34 exists between any adjacent synthetic stones 18. Where the synthetic stones 18 are of uniform size and shape, it is preferred that the gaps 34 between stones are also uniform. This is accomplished by the use of a temporary spacer set between adjacent synthetic stones 18 as the synthetic stones 18 are applied to inner container 14 and that is removed after the stones have set. In an embodiment containing dissimilar shaped synthetic stones 18, the gap 34 size will vary between adjacent synthetic stones 18. The size of the gap 34 will depend on the decorative properties desired. Smaller gaps will exaggerate the stone look, while larger gaps allow for the inclusion of more support to surrounding synthetic stones 18 when the gaps 34 are filled with additional mortar. Preferably, the gaps 34 will not exceed 1 inch in width between adjacent synthetic stones 18.

Upon the like setting of numerous similar synthetic stones 18, the gaps 34 between the stones are filled further with additional mortar. The additional mortar further comprises the adhesive layer 16. The level of fill used in gaps 34 is used to create a desired outer finish of the lawn accessory 10. No additional fill in the gaps 34 results in the prominent display of the synthetic stones 18 and keeps the weight of the accessory minimal. Fully filling the gaps 34 to a level generally parallel with the surface of synthetic stones 18 adds structural support to the lawn accessory 10 and is the preferred embodiment.

Once the synthetic stones 18 are set and the gaps 34 have been filed with additional mortar, a tool is used to provide a finish to the gaps 34. Preferably, a wire brush or stiff bristle broom is run over the gaps 34. As an alternative a towel or similar tool is used to finish the gaps 34.

In an alternate embodiment, inner container 14 comprises a preformed structure made from the same or similar material as that of the adhesive layer 16. For example, inner container 14 comprises a cement or concrete tube secured to a base plate. The tube and base plate are either formed together, or are formed as separate pieces and fastened together such as with the mortar of adhesive layer 16.

The casting process of creating the inner container 14 starts with the filling of a mold with a mortar such as concrete or cement. In this embodiment, the tube and plate contain reinforcement structures such as concrete glue, fibers, or rebar inserted in the casting process. The mold is constructed to result in a finished product that creates the a wall having an inner surface and an outer surface. The thickness of the wall varies depending upon the intended use of the container and the materials used in the casting process. Spacers may be inserted into the mold prior to filling the mold to assure uniform dimensions. As the mold is filled, spacers are removed. The filled mold is tamped and vibrated to remove air pockets. The mold is set aside to cure, or alternatively, is placed in a heat source to accelerate the curing process. After the cast material has set, the mold is removed and the container is allowed additional curing time. Once cured, an adhesive layer is applied and synthetic stones are attached as previously described. Optionally, a reinforcement layer is added and embedded in the adhesive layer.

In one embodiment, a polymer coating is applied to the inner surface of inner container 14, and extends over the top and side surfaces of ring 24. A spray on polymer, such as Rhino Linings™ protects the surfaces covered. The polymer coating prevents the ring 24 from chipping or cracking when removing the stock cover or lid 12. Additionally, it adds structural support by covering the top of inner container 14, ring 24, and adhesive layer 16 with a continuous surface about all three. Similarly, a sealing coat may be added to the outer surface of the finished lawn accessory. The sealing coat is sprayed on or applied with a brush. The sealing coat acts as further protection and is also used to obtain a desired aesthetic finish, such as a glossy shine or dulled natural look.

In another embodiment, inner container 14 contains a nested container (not pictured) which has, at a minimum, an outer dimension smaller than the inner dimension of inner container 14. The nested container contains handles for easy removal from the inner container 14. The nested container is constructed from metal, polymers, or similar rigid materials. Additionally, a plastic liner, such as an ordinary trash bag, is used to cover the inside of the nested container. In this embodiment, the trash bag is put about the nested container with the top of the bag extending over the outer surface of the nested container. The nested container is then inserted into the inner container 14 and lid 12 is placed on the lawn accessory 10 so that the trash bag is not visible.

Figure 3:
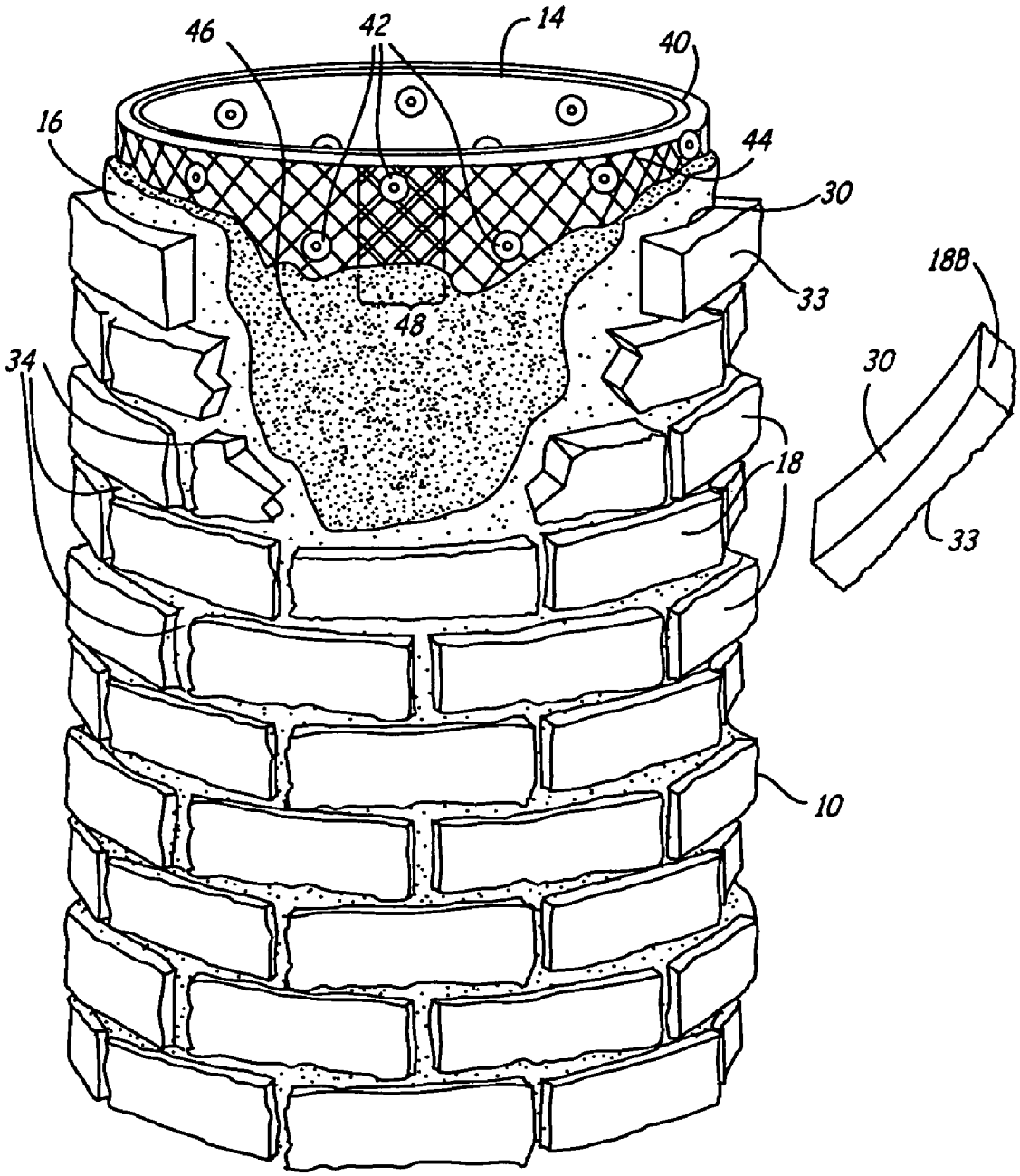
FIG. 3 is a perspective view of a trash receptacle constructed with synthetic stone showing various layers.

FIG. 3 is a perspective view of a trash receptacle constructed with synthetic stones 18. FIG. 3 depicts various partially visible layers. The partially visible layers reflect the steps necessary to create the trash receptacle of the present invention.

The process starts with the inner container 14. The inner container 14 is a preexisting structure comprising one or more walls and a bottom face to create an interior volume. The top of the structure is to remain open. Illustrated in FIG. 3, the inner container 14 is represented as a cylindrical trash receptacle. This is the preferred embodiment, but alternate embodiments allow for containers that are rectangular prisms, cubes, partial spheres, or irregular geometrically shaped objects. In the preferred embodiment the inner container 14 is comprised of a single cylinder wall 26 and a bottom member 28. The inner container 14 is constructed of wood, metal, polymers or a combination thereof. In the preferred embodiment, polymers are used due to great flexibility and light weight, as previously described.

Next, reinforcement layer 44 is attached to the inner container 14. The reinforcement layer 44 gives added structural support to the adhesive layer 16. In the embodiment illustrated in FIG. 3, the reinforcement layer 44 is an expanded metal mesh. In this embodiment, the reinforcement layer 44 is malleable and easily deformed to provide structure as well as support at a desired area of reinforcement layer 44. Reinforcement layer 44 is sized to be the same length as wall 26, and formed into a cylinder having a diameter slightly larger than that of inner container 14. Due to the malleability of the expanded wire mesh of reinforcement layer 44, the mesh can be rolled to form a cylinder. An overlap 48 of the reinforcement layer 44 provides an area for securing the mesh to itself creating a free standing cylinder wall which can be placed over inner container 14. Other examples of acceptable reinforcement layers 44 include polymeric meshes, wire meshes, or a rebar cage to surround the inner container 14. In the embodiment shown, reinforcement layer 44 surrounds the outer circumference of the cylindrical wall of inner container 14. There is a gap 40 left between inner container 14 and reinforcement layer 44. Gap 40 allows for adhesive layer 16 to encapsulate reinforcement layer 44.

Reinforcement layer 44 is attached to inner container 14 by the use of fasteners 42. In the embodiment shown, standard rivets are used to secure reinforcement layer 44 as it is wrapped about inner container 14. The fasteners 42 are randomly placed, in a number to assure reinforcement layer 44 is secured about inner container 14. Fasteners 42 can also be used to secure overlap 48 of the wire mesh when forming reinforcement layer 44, which thus creates a hollow cylinder. The hollow cylinder is placed around the outer wall of inner container 14 and secured with fasteners 42.

The preferred embodiment of inner container 14 as a polymer barrel connotes attaching the mesh of the reinforcement layer 44 to inner container 14. The preferred material of cement or grout of adhesive layer 16 does not readily adhere to a polymer. However, the preferred materials of adhesive layer 16 are self adhesive about a supporting expanded metal mesh. The material of adhesive layer 16 will encase the mesh of reinforcement layer 44 and take the shape of the mesh. Attaching the mesh of reinforcement layer 44 to inner container 14 assures that reinforcement layer 44 is the shape of inner container 14. Thus, adhesive layer 16 will also be the shape of inner container 14. Securing reinforcement layer 44 to inner container 14 with fasteners 42 assure that after adhesive layer 16 is applied about inner container 14. Inner container 14 does not become loose and separate from adhesive layer 16, which results in lost structural support of lawn accessory 10.

After securing reinforcement layer 44 to inner container 14, an initial scratch coat 46 is applied to the structure. The scratch coat 46 becomes part of the adhesive layer 16. The scratch coat 46 is comprised of the mortar used to secure stones 18 to inner container 14. After applying scratch coat 46, a stiff bristled broom or wire brush is run over the scratch coat 46 to create a rough surface. After applying and finishing the scratch coat 46, the structure is allowed to set to dry the mortar of scratch coat 46, preferably 30 days to assure the mortar of adhesive layer 16 is cured. In alternate embodiments, the cure time is greater or less than 30 days depending on the composition of the scratch coat 46.

Once the scratch coat 46 is cured, additional mortar is applied. This additional layer of mortar becomes part of adhesive layer 16. After mortar is applied to the scratch coat 46, mortar is applied to the inner surface 30 of synthetic stones 18. The synthetic stones 18 are then placed around the inner container 14 in the new layer of mortar of adhesive layer 16. The rough surfaces of the scratch coat 46 and inner surface 30 of the synthetic stone 18A provide additional surface area to apply the mortar of adhesive layer 16 to assure a good bond between the synthetic stone 18 and scratch coat 46. Synthetic stones 18 are held in place until the mortar sets enough that synthetic stones 18 are secured in place. Additional mortar is applied to gaps 34 as desired or needed for additional structural support. Once all synthetic stones 18 have been set and gaps 34 have been filled to the desired level, the gaps 34 are gone over with a finishing tool such as a trowel or stiff bristled brush. The mortar of adhesive layer 16 is allowed to cure, preferably for 30 days. After the mortar of adhesive layer 16 is cured, lawn accessory 10 is complete.

As illustrated in FIG. 3, stone 18B is constructed with a curvilinear inner surface 30. Synthetic stone 18B also has a generally flat outer surface 33. The shape and design of synthetic stones 18 are selected so they are aesthetically pleasing with the surrounding environment. Thus, if an architectural structure that is constructed with a synthetic stone 18 exterior, the artisan making the lawn accessory 10 can create a product that will match the exterior of the structure. Lawn accessories made using the above method include trash receptacles, compost bins, imitation wells, planters, recycling bins, and similar structures.

The completed lawn accessory 10 has a texture and properties of natural stone such as a good surface hardness, a good surface abrasion resistance and the like. However, the overall weight of the container is greatly reduced as synthetic stone 18, especially man-made veneer stone, weighs only a fraction of the same amount of natural stone required to achieve a similar finish. The lawn accessory 10 is more portable but just as versatile as the same structure made with natural stone.

Although the present invention has been described with reference to preferred embodiments, workers skilled in the art will recognize that changes may be made in form and detail without departing from the spirit and scope of the invention.

The invention claimed is:

1. A lawn accessory comprising:

an inner container made from at least one polymer and having a wall containing an inner wall surface and an outer wall surface, and a bottom member, wherein the inner wall surface and bottom member create an inner volume of the inner container;

an adhesive layer surrounding the outer wall surface of the inner container, the adhesive layer comprising a mortar;

a coterminous reinforcement layer surrounding the outer wall surface of the inner container, wherein the reinforcement layer is attached to the outer wall surface of the inner container and contained within the adhesive layer;

a decorative layer comprising a plurality of synthetic stones attached to the adhesive layer; and a detachable ring having a top surface, a bottom surface, an inner diameter and an outer diameter, wherein the inner diameter is sized to fit around a combined thickness of the outer wall surface and adhesive layer.

2. The lawn accessory of claim 1 wherein the inner container is a cylindrical barrel.

3. The lawn accessory of claim 1, wherein the reinforcement layer is a mesh.

4. The lawn accessory of claim 1 wherein the plurality of synthetic stones comprises synthetic stones of differing dimensions.

5. The lawn accessory of claim 4 wherein the plurality of synthetic stones are placed in a random configuration.

6. The lawn accessory of claim 1 wherein the plurality of synthetic stones comprise synthetic stones of generally uniform dimensions.

7. The lawn accessory of claim 6 wherein the plurality of synthetic stones are placed in a repeating configuration on the adhesive layer surrounding the outer wall of the inner container.

8. The lawn accessory of claim 1 further comprising:

a top plate having a circumference and a diameter smaller than the outer diameter of the ring; and at least two supports connecting the ring to the top plate, the supports at equal distances from one another around the circumference of both the ring and the top plate.

9. A decorative and functional lawn accessory constructed to compliment an area surrounding its placement, the lawn accessory comprising:

a generally cylindrical main body comprising:

a generally cylindrical wall having a top end and a bottom end; and a bottom member connected substantially adjacent to the bottom end of the cylindrical wall;

an adhesive layer on the wall having an outer surface;

a layer of a plurality of synthetic stones constructed from a premixed material and attached to the generally cylindrical wall by the adhesive layer, each synthetic stone of the layer of a plurality of synthetic stones comprising an inner surface and an outer surface, wherein the inner surface is arced to mate with the outer surface of the adhesive layer; and a detachable lid made of the same premixed material as the layer of stones; the lid comprising a ring, a top plate, and at least two supports, wherein the ring has a top surface, a bottom surface, an inner diameter and an outer diameter, wherein the inner diameter is sized to fit around a combined thickness of the generally cylindrical wall and the adhesive layer.

10. The lawn accessory of claim 9 wherein the ring has a circumference, the top plate has a circumference and a diameter smaller than the outer diameter of the ring, and the supports are at equal distances from one another around the circumference of both the ring and the top plate.

11. A method of constructing a decorative lawn accessory which contains a rigid inner container, a reinforcement layer, an adhesive layer, a decorative layer, and a detachable ring having a top surface, a bottom surface, an inner diameter and an outer diameter, wherein the inner diameter is sized to fit around a combined thickness of the generally cylindrical wall and the adhesive layer, the method comprising the steps of:

a) forming the rigid inner container using at least one of a polymer or concrete or combinations thereof, wherein the rigid container has a wall containing an inner wall surface and an outer wall surface, and a bottom member, wherein the inner wall surface and bottom member create an inner volume of the inner container;

b) attaching the reinforcement layer with fasteners to envelope the outer wall surface of the rigid inner container;

c) applying a scratch coat of mortar to the outer surface of the rigid inner container and surrounding the reinforcement layer;

d) curing the scratch coat of mortar;

e) applying an additional coat of mortar as the adhesive layer;

f) setting a plurality of synthetic stones to the adhesive layer; and g) curing the additional coat of mortar to the adhesive layer.

12. The method of claim 11 wherein the plurality of synthetic stones are constructed from a mix of natural stone powder and synthetic resin to simulate a look of natural stone.

13. The method of claim 11 wherein step f) further comprises:

spacing the plurality of synthetic stones and filling the spaces between individual stones with additional mortar, which becomes part of the adhesive layer.

14. The method of claim 11 wherein step a further comprises: applying a polymer coating to the inner surface of the inner container.

15. The method of claim 11,, further comprising:

h) forming a detachable ring using at least one of a polymer or concrete or mortar or combinations thereof.

* * * * *

UNITED STATES PATENT AND TRADEMARK OFFICE

CERTIFICATE OF CORRECTION

PATENT NO. : 7,648,747 B2
APPLICATION NO. : 11/109546
DATED : January 19, 2010
INVENTOR(S) : Straka et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 731 days.

Signed and Sealed this

Twenty-third Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,648,747 B2
APPLICATION NO. : 11/109546
DATED : January 19, 2010
INVENTOR(S) : Stephen P. Straka and Mark D. Patraw It is certified that error appears in the above-identified patent and that said Letters Patent is hereby corrected as shown below:

Col. 10 lines 24-25,
Delete "envelope"
Insert --envelop--

Signed and Sealed this
Thirteenth Day of September, 2011

David J. Kappos

David J. Kappos
*Director of the United States Patent and Trademark Office*